US006561887B2

(12) United States Patent
Lai et al.

(10) Patent No.: US 6,561,887 B2
(45) Date of Patent: May 13, 2003

(54) PROTECTIVE COVER DETACHABLY INSTALLED ON A CUTTING MACHINE/ ENGRAVING MACHINE COMBINATION

(76) Inventors: Bao Shyan Lai, No. 6, Wu Chan Rd., Taichung (TW); Chung Tsun Cho, No. 1-1, A Li Street, Fu Hsing Hsiang, Chang Hua Hsien (TW)

( * ) Notice: Subject to any disclaimer, the term of this patent is extended or adjusted under 35 U.S.C. 154(b) by 0 days.

(21) Appl. No.: 10/095,068

(22) Filed: Mar. 12, 2002

(65) Prior Publication Data

US 2002/0094769 A1 Jul. 18, 2002

Related U.S. Application Data

(63) Continuation-in-part of application No. 09/505,866, filed on Feb. 17, 2000, now abandoned.

(51) Int. Cl.[7] ..... B24B 23/02

(52) U.S. Cl. ..... 451/358; 451/451; 451/456; 451/359; 403/362

(58) Field of Search ..... 451/451, 452, 451/455, 457, 359, 358; 403/362, 374.3

(56) References Cited

U.S. PATENT DOCUMENTS

| | | | | | |
|---|---|---|---|---|---|
| 2,429,356 | A | * | 10/1947 | Hicks | 433/116 |
| 3,126,021 | A | * | 3/1964 | May | 132/76.4 |
| 3,969,856 | A | * | 7/1976 | Zerrer | 451/451 |
| 4,440,045 | A | * | 4/1984 | Aksamit | 76/80.5 |
| 4,891,915 | A | * | 1/1990 | Yasuda | 451/359 |
| 5,005,321 | A | * | 4/1991 | Barth et al. | 451/359 |
| 5,031,325 | A | * | 7/1991 | Walter et al. | 30/390 |
| 5,163,252 | A | * | 11/1992 | Garner et al. | 451/451 |
| 5,411,433 | A | * | 5/1995 | Keller | 451/451 |
| 6,210,261 | B1 | * | 4/2001 | Johnson | 451/451 |

FOREIGN PATENT DOCUMENTS

| | | | | |
|---|---|---|---|---|
| DE | 36 38 337 | * | 5/1988 | 451/451 |
| DE | 39 40 584 | * | 6/1991 | 451/451 |

* cited by examiner

*Primary Examiner*—George Nguyen
(74) *Attorney, Agent, or Firm*—Charles E. Baxley

(57) ABSTRACT

A protective cover detachably installed on a cutting machine/engraving machine combination including a main body and a protective cover. The protective cover is disposed with a fixing ring which can be directly tightened on an outer thread section of the main body. The gap of the split of the fixing ring can be changed by means of a tightening member so as to tightly engage the inner thread section of the fixing ring with the outer thread section of the main body without loosening. Therefore, the protective cover can be quickly and conveniently installed and taken off from the main body.

2 Claims, 6 Drawing Sheets

PROTECTIVE COVER DETACHABLY INSTALLED ON A CUTTING MACHINE/ ENGRAVING MACHINE COMBINATION

CROSS-REFERENCE TO RELATED APPLICATION

This application is a Continuation-In-Part Application of Ser. No. 09/505,866, filed Feb. 17, 2000 now abn., and entitled "PROTECTIVE COVER DETACHABLY INSTALLED ON A CUTTING MACHINE/ENGRAVING MACHINE COMBINATION."

BACKGROUND OF THE INVENTION

The present invention relates to a protective cover detachably installed on a cutting machine/engraving machine combination, and more particularly to a protective cover which can be quickly, safely and conveniently installed and taken off from the main body according to the using state of the combination.

FIG. 6 shows a conventional cutting machine having a main body 8 in which a pneumatic motor (not shown) is installed. A rotary shaft 82 of the motor is coupled with a sand disk 83 for cutting off a work piece. The front end of the main body 8 is disposed with a thread section 84. A nut 85 is screwed on the thread section 84 to tighten a protective cover 86 which partially covers the sand disk 83. When cutting a work piece, the sand disk 83 may be broken and sparks will be produced so that the protective cover serves to protective a user from being hurt by the broken sand disk and prevent the sparks from affecting the sight of the user or burning the user. Therefore, it must be ensured that the protective cover is truly fixed without loosening. Otherwise, the safety in use of the cutting machine can be hardly ensured. When the sand disk 83 is replaced by a grinding stone 91 and relevant components, the cutting machine is changed into an engraving machine (as shown in FIG. 7). However, when using the engraving machine, the protective cover 86 is unnecessary and is changed into a flat cover 92 so that the protective cover must be detached and removed. At this time, a user must untighten the nut 85 with a large wrench. Such operation is quite inconvenient for the user. Moreover, when untightening or tightening the nut 85, due to the obstruction of the protective cover 86 (the protective cover 86 has small openings on two sides), each time the wrench can untighten or tighten the nut by a small angle so that such procedure is quite troublesome and time-consuming.

SUMMARY OF THE INVENTION

It is therefore a primary object of the present invention to provide a protective cover detachably installed on a cutting machine/engraving machine combination. The protective cover is disposed with a fixing ring which can be directly tightened on an outer thread section of the main body. The gap of the split of the fixing ring can be changed by means of a tightening member so as to tightly engage the inner thread section of the fixing ring with the outer thread section of the main body without loosening. Therefore, the protective cover can be quickly and conveniently installed and taken off from the main body.

According to the above object, the combination includes:

a tubular main body, a motor being disposed in the main body, a switch being disposed on an outer side of the main body to control the rotation of the motor, the motor having a rotary shaft axially forward protruding out of the main body, a front end of the rotary shaft being fixed with a sand disk or a grinding stone, an outer thread section being disposed at the front end of the main body, the outer thread section can be alternatively fixed with a flat cover or a protective cover; and a protective cover disposed at the front end of the main body to cover one half of the sand disk, a rear end of the protective cover having a fixing ring disposed on the outer thread section of the main body, the inner wall of the fixing ring is formed with an inner thread section cooperating with the outer thread section of the main body, the fixing ring being formed with a split, the fixing ring being disposed with a tightening member on two sides of the split. By means of tightening or untightening the tightening member, the gap of the split can be changed so as to tighten the fixing ring on the outer thread section of the main body.

The present invention can be best understood through the following description and accompanying drawings wherein:

DETAILED DESCRIPTION OF THE PREFERRED EMBODIMENTS

Figure 1A:
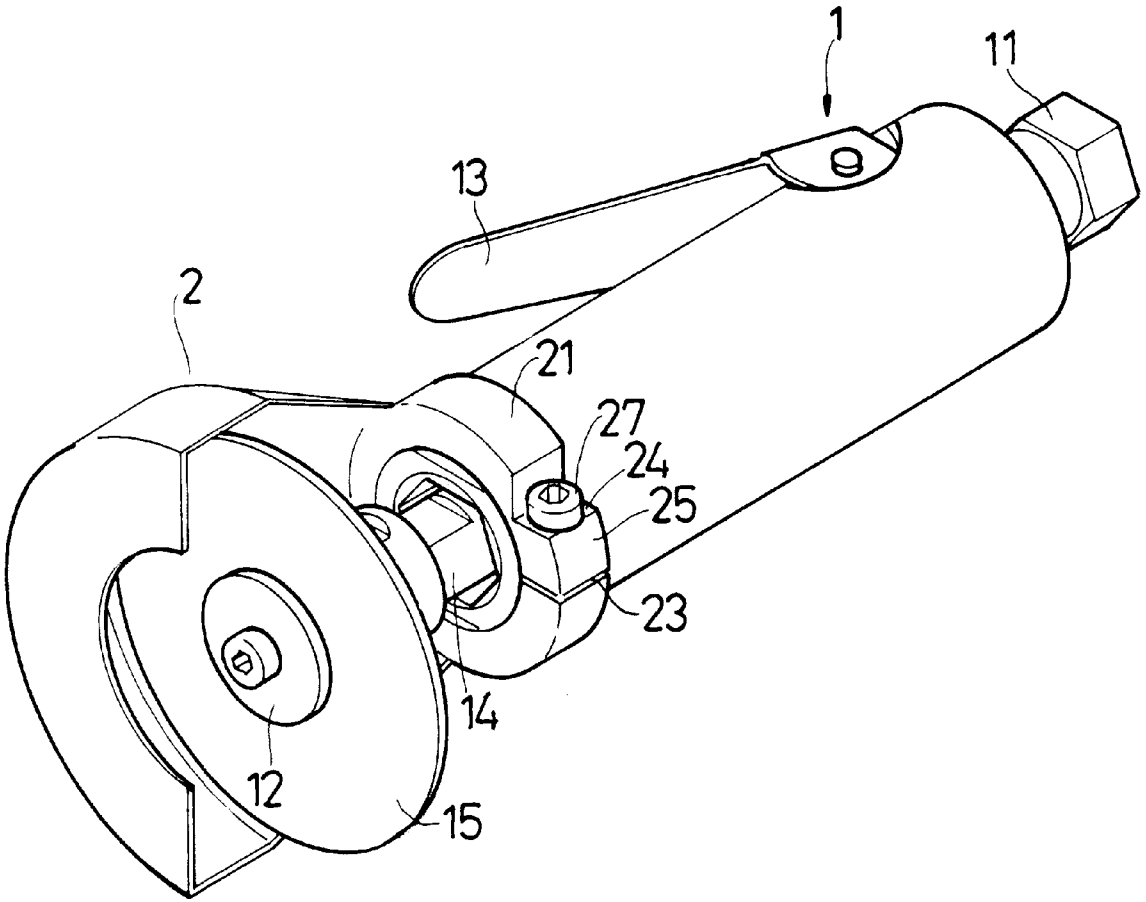
FIG. 1A is a perspective assembled view of a protective cover installed on a cutting machine/engraving machine combination of the present invention.
Figure 1B:
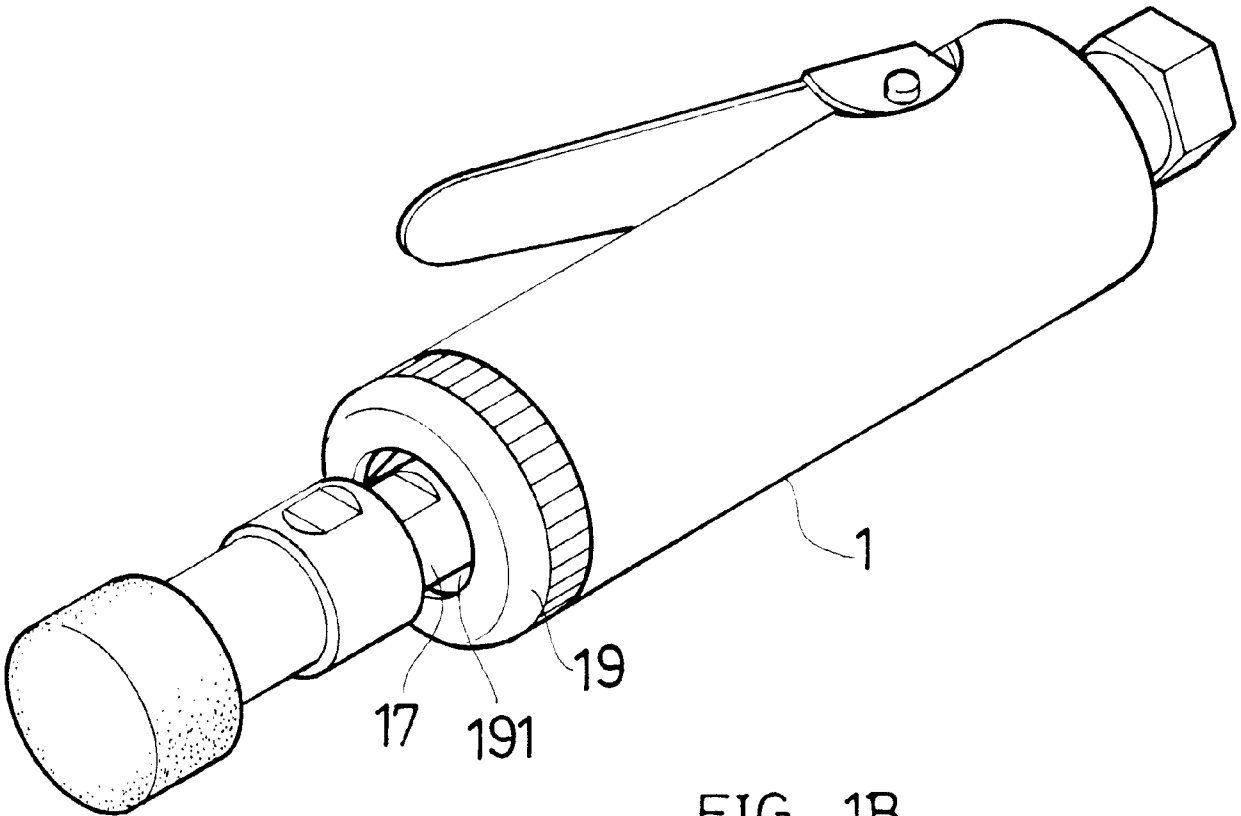
FIG. 1B is a perspective assembled view of a flat cover installed on a cutting machine/engraving machine combination of the present invention.
Figure 2:
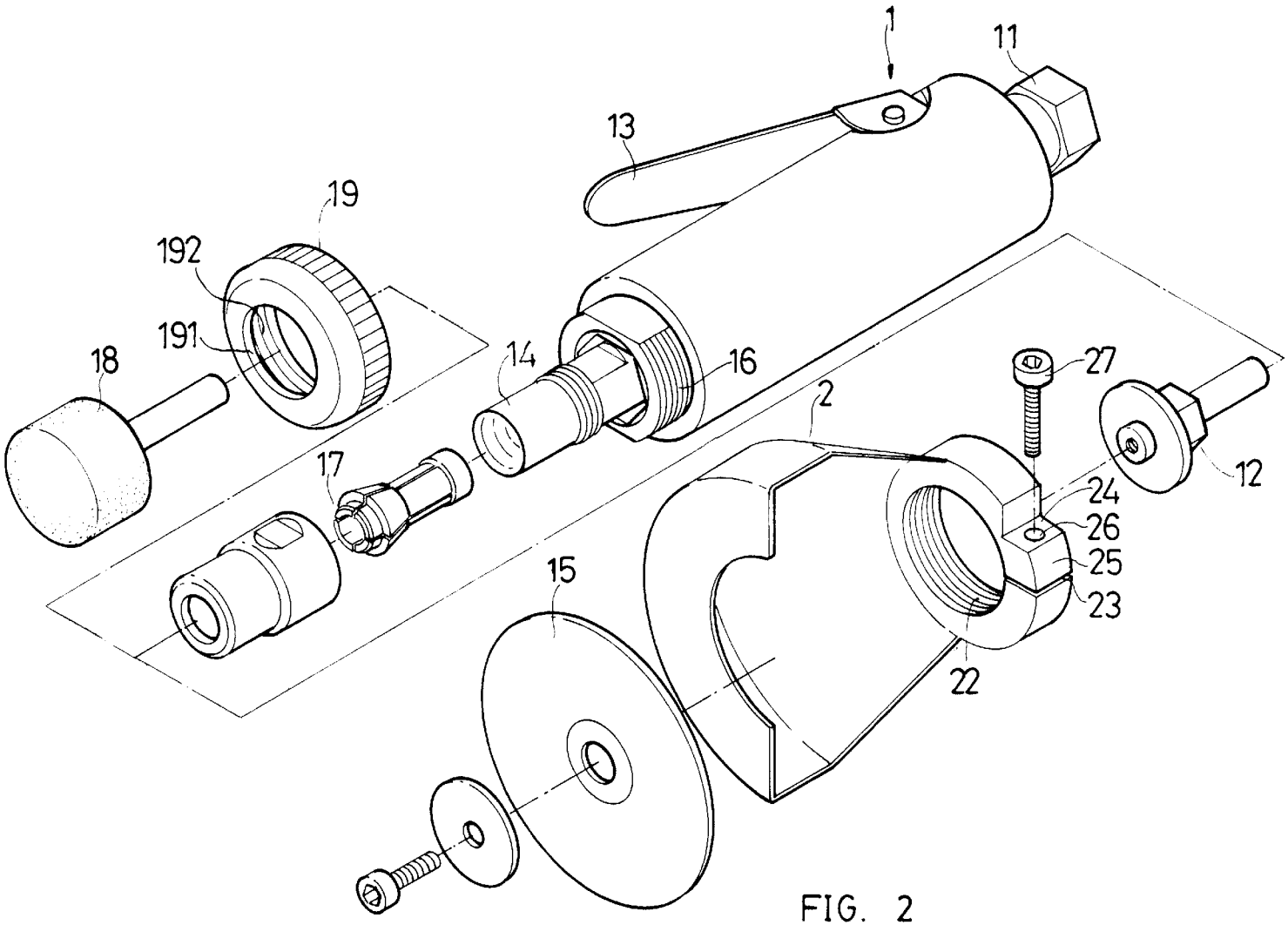
FIG. 2 is a perspective exploded view of the present invention.

Please refer to FIGS. 1 to 5. The pneumatic cutting machine of the present invention includes:

a tubular main body 1, a rear end of the main body being formed with an air inlet 11, a pneumatic motor (not shown) being disposed in the main body 1, a switch 13 being disposed on an outer side of the main body 1 to control the rotation of the pneumatic motor, the pneumatic motor having a rotary shaft 14 axially forward protruding out of the main body 1, a front end of the rotary shaft 14 being disposed with a cylindrical chuck 17 for fixing a grinding stone 18 or a locating member 12 for fixing a sand disk 15, an outer thread section 16 with smaller outer diameter being fitted in the front end of the main body 1 and partially protruding therefrom, the outer thread section 16 can be alternatively fixed with a flat cover 19 or a protective cover 2; and the flat cover 19 having a hole 191 for the cylindrical chuck 17 to pass through the hole 191, the flat cover 19 further formed with an inner thread section 192 to rotary lock the outer thread section 16 of the main body 1; and the case-like protective cover 2 disposed at the front end of the main body 1 on the same side as the switch 13 to cover one half of the sand disk 15, a rear end of the protective cover 2 having a fixing ring 21 formed with an inner thread section 22 cooperating with the outer thread section 16 of the main body 1, the fixing ring 21 being formed with a split 23 on one side opposite to the protective cover 2, the fixing ring 21 being formed with a cut plane 24 on the side with the split 23 so that a lug 25 is defined on one side of the cut plane 24, the lug 25 being formed with a through hole 26 passing through the lug 25 to one side of the split 23, the fixing ring 21 being further formed with a thread hole 28 coaxial with the through hole 26 on the other side of the split 23, a tightening screw 27 being screwed into the through hole 26 and the thread hole 28.

Figure 3:
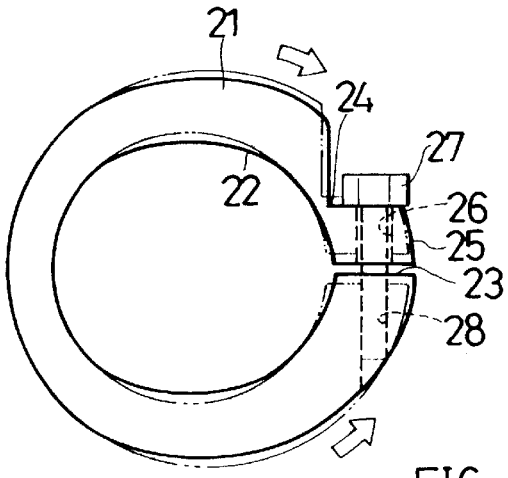
FIG. 3 shows that the fixing ring is tightened.
Figure 4:
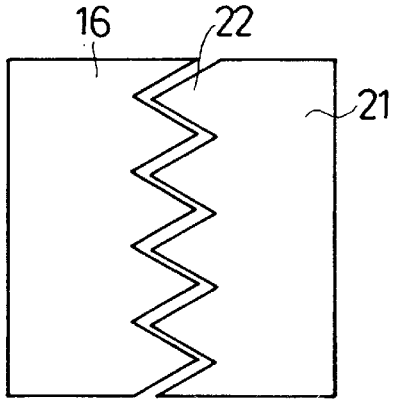
FIG. 4 shows that the outer thread section and inner thread section are not tightly engaged with each other.
Figure 5:
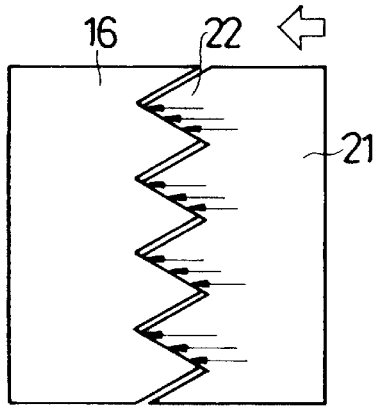
FIG. 5 shows that the outer thread section and inner thread section are tightly engaged with each other.
Figure 6:
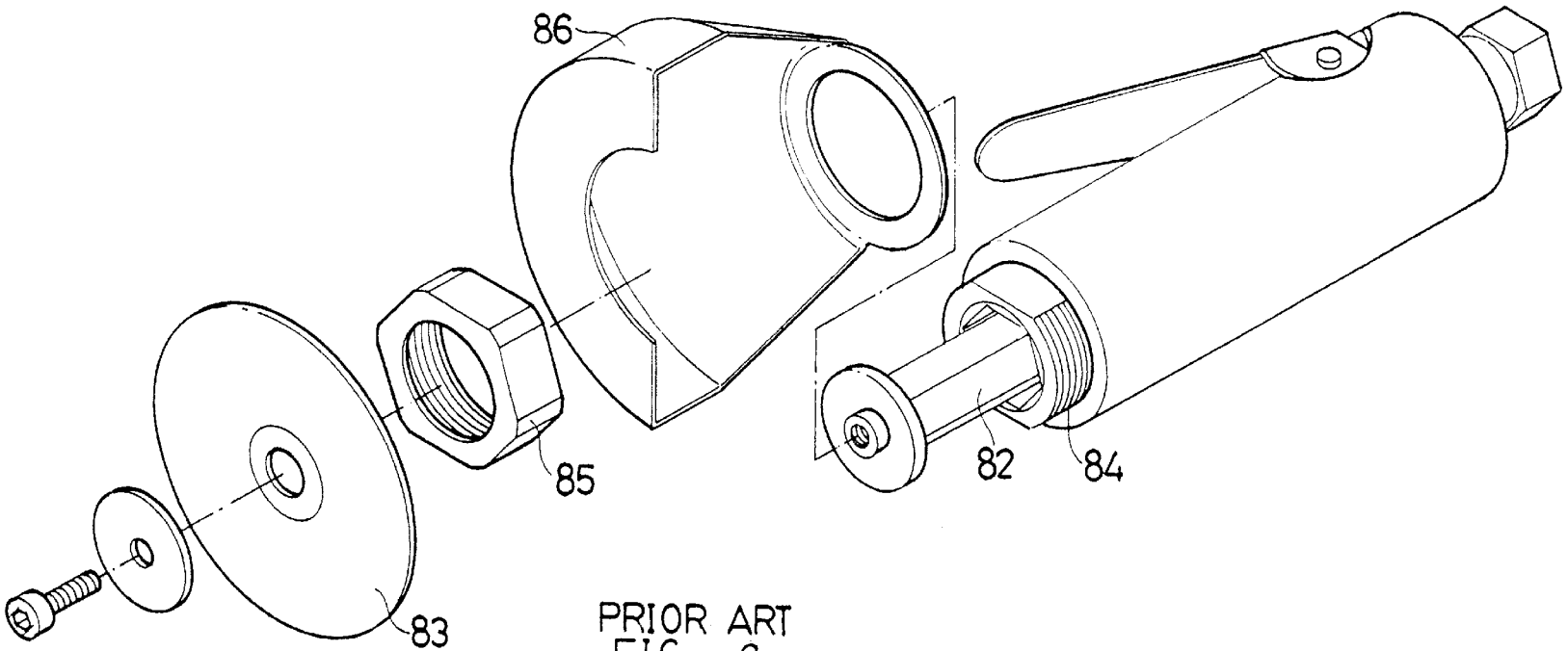
PRIOR ART FIG. 6
FIG. 6 is a perspective exploded view of a conventional cutting machine.
Figure 7:
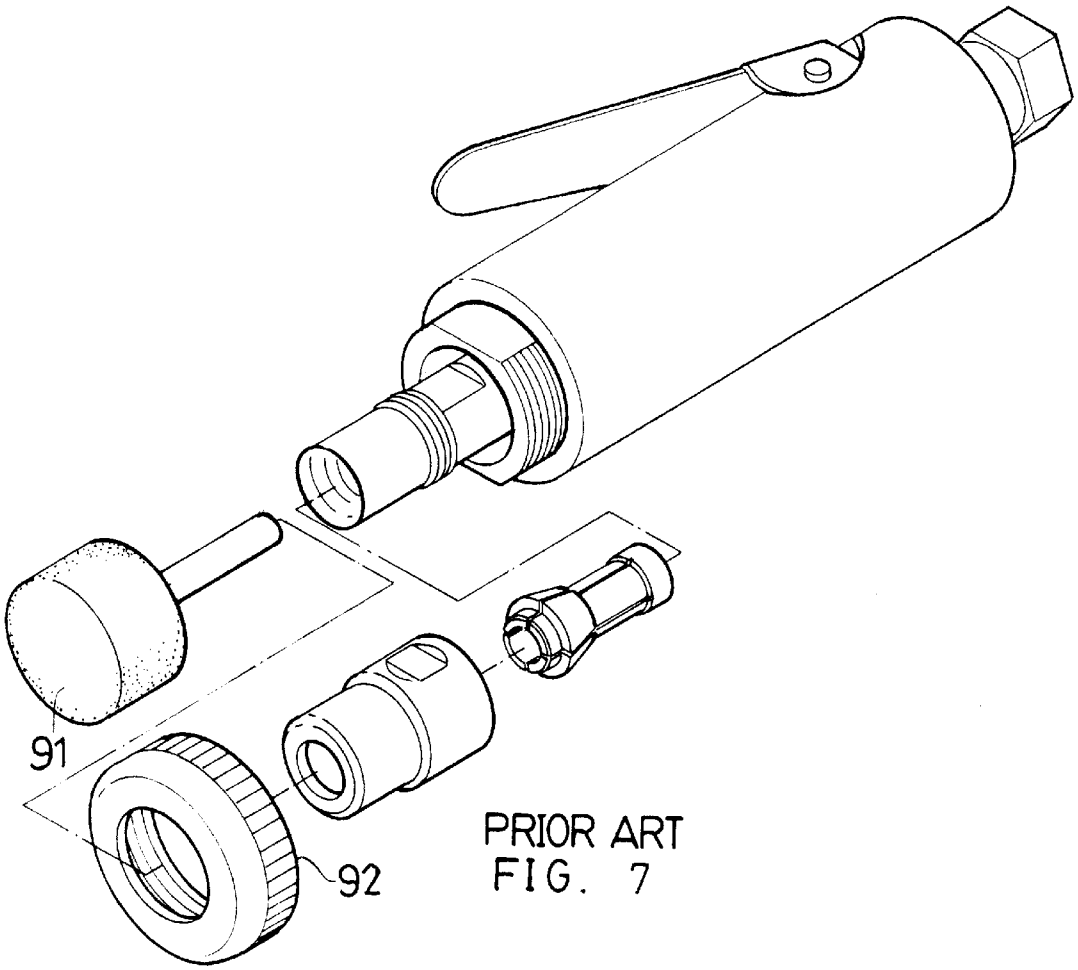
PRIOR ART FIG. 7
FIG. 7 is a perspective exploded view of a conventional engraving machine.

It should be noted that the fixing ring 21 is made of a resilient material. The inner thread section 22 of the fixing ring 21 is loosely screwed onto the outer thread section 16 of the main body 1. When the tightening screw 27 is tightened in the thread hole 28, the side of the fixing ring 21 opposite to the split 23 serves as a fulcrum and two ends of the fixing ring 21 are forced to get closer to each other by the tightening screw 27 (as shown in FIG. 3). The thread of the outer thread section 16 obliquely extends by a predetermined guide angle and the fixing ring 21 radially tightly clamps the outer thread section 16 respectively from two sides of the protective cover 2. Therefore, the inner thread section 22 of the fixing ring 21 will not move along the guide angle of the outer thread section 16 so that the thread face of the inner thread section 22 and the thread face of the outer thread section 16 will tightly engage with each other ( as shown in FIG. 5). By means of the engagement therebetween, the fixing ring 21 will not loosen from the outer thread section 16.

When assembling the protective cover 2, first the rotary shaft 14 of the main body 1 is passed through the fixing ring 21 of the protective cover 2 and the fixing ring 21 is slightly tightened on the outer thread section 16. Then the tightening screw 27 is tightened by a wrench. At this time, the outer thread section 16 and the inner thread section 22 are tightly engaged with each other to prevent the fixing ring 21 from loosening due to the shock in work. Finally, the sand disk 15 is fixed on the rotary shaft 14. When it is desired to take off the protective cover 2 and apply the main body 1 to an engraving machine, a reverse operation is performed to take off the sand disk 15 and the protective cover 2. Then the flat cover 19 is fixed on the outer thread section 16 of the main body 1. Finally the grinding stone 18 is fixed in the cylindrical chuck 17.

According to the above arrangement, the tightening screw 27 can be turned conveniently by a general small wrench and the wrench can be rotated by a quite large angle so that the tightening and untightening can be both quickly performed. Therefore, the protective cover 2 can be installed or taken off by a user himself, depending on the using state.

What is claimed is:

1. A protective cover detachably installed on a cutting machine/engraving machine combination, wherein the combination comprising:

a tubular main body, a pneumatic motor being disposed in the main body, a switch being disposed on an outer side of the main body to control the rotation of the pneumatic motor, the pneumatic motor having a rotary shaft axially forward protruding out of the main body, a front end of the rotary shaft being fixed with a sand disk or a grinding stone, an outer thread section being disposed at the front end of the main body, the outer thread section can be alternatively fixed with a flat cover or a protective cover; and the protective cover disposed at the front end of the main body to cover one half of the sand disk, a rear end of the protective cover having a fixing ring disposed on the outer thread section of the main body, said protective cover being characterized in that the inner wall of the fixing ring is formed with an inner thread section cooperating with the outer thread section of the main body, the fixing ring being formed with a split, the fixing ring being disposed with a tightening member on two sides of the split, whereby the tightening member is able to change the gap of the split so as to tighten the fixing ring on the outer thread section of the main body.

2. The protective cover detachably installed on a cutting machine/engraving machine combination as claimed in claim 1, wherein the fixing ring has at least one cut plane on one side of the split, whereby a lug is formed on the fixing ring on one side of the cut plane, the fixing ring being formed with two through holes respectively on two sides of the split, the two through holes being coaxial with each other, one of the through holes being a thread hole, the tightening member being a tightening screw which can be screwed into the thread hole.

* * * * *